United States Patent [19]

Bainbridge et al.

[11] Patent Number: 4,826,724

[45] Date of Patent: May 2, 1989

[54] MOLDABLE FIBROUS MAT

[75] Inventors: David W. Bainbridge, Lakewood; Mario P. Tocci, Littleton, both of Colo.

[73] Assignee: Manville Corporation, Denver, Colo.

[21] Appl. No.: 204,843

[22] Filed: Jun. 10, 1988

[51] Int. Cl.[4] ..... D04H 1/58

[52] U.S. Cl. ..... 428/288; 428/280; 428/289; 428/290; 428/492; 428/920; 428/224

[58] Field of Search ..... 428/288, 289, 290, 280, 428/920, 492, 224

[56] References Cited

U.S. PATENT DOCUMENTS

| | | | |
|---|---|---|---|
| 4,508,777 | 4/1985 | Yamamoto et al. | 428/288 |
| 4,596,737 | 6/1986 | Werbowy et al. | 428/228 |
| 4,673,616 | 6/1987 | Goodwin | 428/289 |

*Primary Examiner*—James J. Bell

*Attorney, Agent, or Firm*—John D. Lister

[57] ABSTRACT

A thermoformable fibrous mat which has good strength and temperature resistance and which combines balanced properties of flexibility and rigidity. The novel, inventive mat comprises glass fibers; polyolefin fibers; polyamide and/or polyester fibers; and a cross-linked latex binder. Preferably, the latex binder is a combination of styrene-butadiene and carboxylated styrene-butadiene. A process for forming the inventive mat is also disclosed.

6 Claims, No Drawings

MOLDABLE FIBROUS MAT

FIELD OF THE INVENTION

The invention relates to a fibrous mat and more particularly, it relates to a moldable mat composed of organic and glass fibers which is especially useful as an automobile topliner. This invention further relates to a process for making a molded, fibrous insulation material.

BACKGROUND OF THE INVENTION

It is common within the automobile industry to use glass fiber wools in the production of molded automotive insulation products, e.g. topliners. Glass fiber wools are typically made by first impregnating glass fibers with a thermosetting binder, such as a phenolic resin, and thereafter consolidating the glass fibers and thermosetting binder into a loosely packed mass. This mass is then passed to an oven where the bonded glass fibers are compressed to a selected thickness and density and then cured at a relatively high temperature, e.g. 550° F.

Automotive insulation products fashioned from these glass fiber wools and the process for producing these wools and insulation products are not without drawbacks and limitations, however.

To begin with, the glass fiber has a tendency to be too rigid for many potential applications because of the brittleness imparted to the fiber by the thermosetting, e.g. phenolic, resin binder. Furthermore, the glass fibers are not always strong enough for various end uses such as hoodliners, van converter door panels, and package trays.

Because of the thermosetting binder, high mold temperatures and specialized aluminum molds must be employed. And because high temperature molds must be used, low melting point materials cannot be laminated onto the glass fibers during the initial molding process. Thus, if lamination is to occur the molded fiber must be cooled down considerably beforehand.

While other materials have been available such as modified glass fiber mats and non-woven textiles, their uses have not been without limitations either.

For example, U.S. Pat. No. 4,596,737 discloses a glass fiber mat containing a heat curable, thermosetting binder. Additionally, the mat is impregnated with a latex resin to impart a degree of flexibility to the mat. While the disclosed mat has some degree of flexibility, it can still have too much rigidity and too low of strength for various end uses as automotive insulation. Furthermore, the foregoing disclosed limitations associated with lamination would still be present.

U.S. Pat. No. 4,673,616 discloses a moldable latex impregnated textile material composed of organic fibers needled into a non-woven web of sheet. The latex impregnant contains a filler and a stiffener such as styrene-butadiene. The use of only organic fibers in the mat, however, presents a temperature stability problem at temperatures of around 200° F. or higher as there will be a tendency of the mat to droop during molding.

What is needed in the industry is a fibrous mat product which has sufficient strength and temperature stability and which is flexible yet rigid enough to find a variety of end uses as insulation and the like within the automotive and other industries. What is also needed is a process for making molded fibrous insulation products which avoids the difficulties and limitations possessed by the conventional process.

BRIEF SUMMARY OF THE INVENTION

In one embodiment of the present invention, Applicants have provided a novel, moldable fibrous mat which has good strength and temperature resistance and which combines balanced properties of flexibility and rigidity thus enabling the mat to have a variety of end uses as insulation, especially within the automotive industry. Briefly, Applicants' novel fibrous mat comprises about: (a) 20–60 wt% glass fibers; (b) 10–60 wt% polyolefin fibers; (c) 1–50 wt% fibers selected from the group consisting of polyamide fibers, polyester fibers, and mixtures thereof; and (d) 20–50 wt% of a cross-linked latex binder. In a preferred embodiment, about 5–10 wt% of an alkali metal silicate is added in order to impart additional temperature stability and fire resistance to the inventive mat.

In another embodiment, there is provided a novel process for producing strong, temperature resistant molded fibrous insulation products which have a good balance between the properties of rigidity and flexibility. Applicants' novel process comprises the steps of: (a) combining 20–60 wt% glass fibers; 10–60 wt% polyolefin fibers; 1–50 wt% fibers selected from the group consisting of polyamide fibers, polyester fibers, and mixtures thereof; and 20–50 wt% cross linkable latexes; (b) consolidating the fibers and binder into a loosely packed mat; (c) curing the consolidated mat of fibers and binder at a temperature in the range of about 250°–400° F.; and (d) thereafter molding the cured mat of fibers into a desired insulation shape at ambient temperature conditions. In a preferred embodiment, the insulation shape is laminated during the molding process.

The inventive process is clearly advantageous over conventional processes because relatively lower temperatures can be used in both the curing and molding processes. Furthermore, lamination of the insulation product with a wide range of materials is easy because of the lower cure temperatures required. Furthermore, the molding and lamination steps are very economical to practice because there is no need to use expensive, specialized aluminum molds, e.g. an epoxy based cold mold may be used in the present invention.

Other features and aspects, as well as the various benefits, of the present invention will be made clear in the more detailed description which follows.

DETAILED DESCRIPTION OF THE INVENTION

Table I below lists the components of the inventive mat at the indicated weight percentage levels based upon the total weight of the inventive mat.

TABLE I

| Component | General | Preferred |
|---|---|---|
| Glass fibers | 20–60 | 45–55 |
| Polyolefin fibers | 10–40 | 30–35 |
| Polyamide/Polyester Fibers | 1–50 | 15–20 |
| Latex Binder | 20–50 | 30–35 |
| Alkali Metal Silicate | | 5–10 |

In the present invention, the glass fibers utilized can be those produced in any conventional manner or alternatively, any of those which are commercially available can be used. The glass fibers are typically produced by flowing streams of molten materials through small orifices and then drawing out the streams at speeds capable of attenuating the materials into fibers of desired diameters. Preferably, the glass fibers utilized will have an average fiber diameter of between about 6 to 15 microns. The glass fibers impart temperature stability and strength to the inventive mat.

Any commercially available polyolefin fibers may be used in the present invention. Polypropylene fibers are presently preferred. Preferably, whatever polyolefin fiber employed will have a filament size in the range of about 3 to 15 denier per filament and a fiber length of about 0.25 to 1.5 inches.

The polyolefin fibers are used in the invention to increase elongation of the mat, i.e. moldability, and to impart a tackiness quality to the mat which assists the latex binder.

Polyamide fibers, polyester fibers, or mixtures thereof are also utilized in the present invention. Nylon fibers of 3.0 to 6.0 denier per filament and of from 0.25 to 1 inch in length are preferred.

The polyamide and polyester fibers are utilized in the inventive mat to increase its strength.

The latex binders employed in the present invention are those which will cross-link at temperatures broadly in the range of about 75°-300° F. and preferably in the range of about 100° to 250° F. The cross-linked latex binder imparts balanced properties of flexibility and rigidity to the inventive fibrous mat. Examples of cross-linkable latexes include, but are not limited to polystyrene, styrene-acrylate, styrene-acrylonitrile, styrene-butadiene, carboxylated styrene-butadiene, and the like.

Presently preferred for use in the invention as a latex binder are a mixture of 5-20 wt% DOW DL 277A, a styrene/butadiene latex, and 80-95 wt% DOW XU-308-43.00, a carboxylated styrene/butadiene latex, both of which are manufactured by Dow Chemical Company of Midland, Mich. Most preferred is a 10%/90% combination.

The binder may contain one latex which will cross-link with itself or alternatively, two or more latexes which will cross-link with one another.

In order to impart additional temperature stability and heat resistance to the mat, it is preferred to add about 5-10 wt% alkali metal silicate, such as potassium or magnesium silicate.

Preferably, the inventive fibrous mat will have a thickness in the range of from about 0.01 to 0.50 inches.

The inventive process for forming fibrous insulation products comprises the step of first combining 20-60 wt% glass fibers; 10-60 wt% polyolefin fibers; 1-50 wt% polyamide or polyester fibers or mixtures thereof; and 20-50 wt% of a cross-linkable latex binder.

The cross-linkable latex binder and fibers are combined in any suitable manner. Typically, the fibers are dispersed and mixed together in an aqueous medium with the use of suitable dispersion aids and viscosity control agents as needed. The fibers are then randomly collected on a forming wire. The collected fibrous mat is then conveyed to a receptacle containing the liquid, cross-linkable latex binder where the mat is saturated with binder and then the excess binder is removed by suction.

The fibers are then consolidated into a loosely packed mat which is then cured at a temperature in the range of about 250°-400° F., preferably about 325°-375° F. and most preferably about 375° F. The cured consolidated fibrous mat is then molded into a desired insulation shape at ambient temperature conditions, e.g. room temperature. The molding typically will be done in a cold mold such as an epoxy based mold.

In a preferred embodiment, the shaped insulation product will be laminated on one or more sides during the molding process with a suitable facing material such as, for example, knap knit foam backed cloth.

Typical compositions (wt%) of the inventive mat are given in the following non-limiting examples.

EXAMPLE 1

| | |
|---|---|
| Glass Fiber | 46.2 |
| Nylon Fiber | 6.5 |
| Polypropylene Fiber | 12.3 |
| Latex Binder | 35.0 |

EXAMPLE 2

| | |
|---|---|
| Glass Fiber | 32.5 |
| Nylon Fiber | 3.3 |
| Polypropylene Fiber | 29.2 |
| Latex Binder | 35.0 |

EXAMPLE 3

| | |
|---|---|
| Glass Fiber | 32.5 |
| Nylon Fiber | 13.0 |
| Polyethylene Fiber | 19.5 |
| Latex Binder | 35.0 |

EXAMPLE 4

| | |
|---|---|
| Glass Fiber | 26.0 |
| Nylon Fiber | 6.5 |
| Polypropylene Fiber | 19.5 |
| Polyethylene Fiber | 13.0 |
| Latex Binder | 35.0 |

EXAMPLE 5

| | |
|---|---|
| Glass Fiber | 32.5 |
| Polypropylene Fiber | 22.8 |
| Nylon Fiber | 9.7 |
| Latex Binder | 35.0 |

The fibers used in the foregoing examples were of the following dimensions (diameter × length):

Glass Fibers: 10 micron × ½"

Nylon Fibers: 3 denier × ¼"

Polypropylene Fibers: 15 denier × ½"

Polyethylene Fibers: 1.7 denier × ¼"

The latex binder employed was a combination styrene-butadiene/carboxylated styrene-butadiene.

Inventive Mats 1, 2, and 4 did not sag at 250° F. Inventive Mat 3 did not sag at 150° F. Inventive Mat 5 provided the best results as it did not exhibit any sagging at 300° F. Test mats were all 100 g/ft$^2$ basis weight with a 0.1 inch thickness prior to molding.

Reasonable modifications and variations are possible from the foregoing disclosure without departing from either the spirit or scope of the present invention as defined in the claims.

We claim:

1. A fibrous mat comprising about:

(a) 20–60 wt% glass fibers;

(b) 10–60 wt% polyolefin fibers;

(c) 1–50 wt% fibers selected from the group consisting of polyamides; polyesters; and mixtures thereof; and (d) 20–50 wt% cross-linked latex binder.

2. A fibrous mat according to claim 1 comprising about:

(a) 45–55 wt% glass fibers;

(b) 30–35 wt% polyolefin fibers;

(c) 15–20 wt% fibers selected from the group consisting of polyamides; polyesters; and mixtures thereof;

(d) 30–35 wt% cross-linked latex binder; and (e) 5–10 wt% alkali metal silicate.

3. A fibrous mat according to claim 1 wherein said polyolefin fibers are selected from the group consisting of polyethylene; polypropylene; and mixtures thereof.

4. A fibrous mat according to claim 1 wherein said polyamide fiber is a nylon.

5. A fibrous mat according to claim 1 wherein said latex binder is one which will cross-link at a temperature in the range of about 75°–300° F.

6. A fibrous mat according to claim 1 wherein said latex binder is a combination of styrene-butadiene and carboxylated styrene-butadiene.

* * * * *